United States Patent [19]

Hamamura et al.

[11] Patent Number: 4,959,273

[45] Date of Patent: Sep. 25, 1990

[54] CORROSION-RESISTANT PERMANENT MAGNET AND METHOD FOR PREPARING THE SAME

[75] Inventors: Atsushi Hamamura, Kyoto; Takaki Hamada; Kouki Tokuhara, both of Takatsuki; Yukimitsu Miyao, Fujiidera; Tomoyuki Imai; Nanao Horiishi, both of Hiroshima, all of Japan

[73] Assignees: Sumitomo Special Metals Co., Ltd.; Toda Kogyo Corp., both of Hiroshima, Japan

[21] Appl. No.: 408,243

[22] Filed: Sep. 18, 1989

[30] Foreign Application Priority Data

Sep. 20, 1988 [JP] Japan ..... 63-237125

[51] Int. Cl.[5] ..... B22F 7/00

[52] U.S. Cl. ..... 428/548; 419/7; 419/9; 427/408; 428/553; 428/557; 428/500

[58] Field of Search ..... 419/7, 9; 427/408; 428/548, 553, 557, 900

[56] References Cited

U.S. PATENT DOCUMENTS

| | | | |
|---|---|---|---|
| 3,998,669 | 12/1976 | Strnat | 428/558 |
| 4,049,475 | 9/1977 | Houska | 148/103 |
| 4,162,672 | 7/1979 | Yazaki | 428/900 |

FOREIGN PATENT DOCUMENTS

| | | |
|---|---|---|
| 0101552 | 7/1983 | European Pat. Off. . |
| 0106948 | 7/1983 | European Pat. Off. . |
| 0134304 | 9/1983 | European Pat. Off. . |
| 0166597 | 6/1985 | European Pat. Off. . |
| 0190461 | 12/1985 | European Pat. Off. . |
| 0255816 | 7/1987 | European Pat. Off. . |
| 1389867 | 3/1964 | France . |
| 59-46008 | 3/1984 | Japan . |
| 59-64733 | 4/1984 | Japan . |
| 59-89401 | 5/1984 | Japan . |
| 59-132104 | 7/1984 | Japan . |
| 60-34005 | 2/1985 | Japan . |
| 60-54406 | 3/1985 | Japan . |
| 60-153109 | 8/1985 | Japan . |
| 61-150201 | 7/1986 | Japan . |
| 61-166115 | 7/1986 | Japan . |
| 61-166116 | 7/1986 | Japan . |
| 61-166117 | 7/1986 | Japan . |
| 63-238240 | 10/1988 | Japan . |
| 63-254702 | 10/1988 | Japan . |
| 63-255376 | 10/1988 | Japan . |
| 63-266020 | 11/1988 | Japan . |

OTHER PUBLICATIONS

Patent Abstract–Japanese Kokai No. 63–238240.
Patent Abstract–Japanese Kokai No. 63–255376.
Patent Abstract–Japanese Kokai No. 63–254702.
Patent Abstract–Japanese Kokai No. 63–266020.
Patent Abstract–Japanese Kokai No. 60–153109.

*Primary Examiner*—Stephen J. Lechert, Jr.
*Attorney, Agent, or Firm*—Wegner & Bretschneider

[57] ABSTRACT

A corrosion-resistant R-Fe-B type sintered permanent magnet exhibiting deterioration of not more than 5 % from the initial magnetic properties after being tested for 500 hours under the conditions of a temperature of 80° C. and a relative humidity of 90 % is produced by: causing at least one colloidal noble metal selected from the group consisting of Pd, Ag, Pt and Au to be adsorbed in a colloidal state or forming a thin layer thereof through vapor deposition on the surface of the sintered body; applying at least one base metal selected from the group consisting of Ni, Cu, Sn and Co containing P and/or B by electroless plating; and further applying at least one base metal selected from the same group.

The noble metal layer is 1–10 nm thick. The electroless plating layer is no more than 10 μm and the electrolytic plating layer 5–60 μm thick.

44 Claims, No Drawings

CORROSION-RESISTANT PERMANENT MAGNET AND METHOD FOR PREPARING THE SAME

FIELD OF THE INVENTION

This invention relates to an Fe-B-R type permanent magnet having high magnetic properties, excellent adhesivity and corrosion resistance, essentially the corrosion resistance when the magnet is left for long time under the atmosphere of the relative humidity of 90% at 80° C. It is concerned with an Fe-B-R type permanent magnet having a noble metal layer, an electroless plating layer of base metal and an electrolytic plating layer of base metal, stacked on its surface, and exhibiting excellent adherence, lesser deterioration from the initial magnetic properties as demonstrated in tests on the corrosion resistance, and highly stable magnetic properties.

DEFINITION

The symbol "R" represents generally rare earth elements (lanthanides) and Y in this application, and these elements are collectively referred to as "rare earth elements" for the purpose of this application.

BACKGROUND

There was previously proposed, as an improved permanent magnet of high performance which exceeded the highest magnetic properties of the conventional rare earthcobalt magnet, an Fe-B-R type permanent magnet, which was composed as the principal components of iron (Fe), boron (B) and light rare earth elements such as neodymium (Nd) and praseodymium (Pr) abundantly available in natural resources, and which was free of expensive samarium (Sm) or cobalt (Co) (Japanese Patent KOKAI Publications Nos. 59-46008 (1984) and 59-89401 (1984) or EPA 101552).

The alloy of the above mentioned magnet has the Curie temperature which is usually in the range from 300° to 370° C. However, another Fe-B-R type permanent magnet having a higher Curie temperature may also be prepared by substituting cobalt (Co) for a part of iron (Fe) (Japanese Patent KOKAI Publications Nos. 59-64733 (1984) and 59-132104 (1984) or EPA 106949).

With a view to improving the temperature characteristics, in particular the coercivity iHc, and retaining however the Curie temperature equal to or higher than and a (BH)max higher than the above mentioned Co-containing Fe-B-R type (i.e., (Fe, Co)-B-R type rare earth permanent magnet, there was also proposed still another Co-containing Fe-B-R type rare earth permanent magnet in which at least one of heavy rare earth metals such as dysprosium (Dy) or terbium (Tb) is included as a part of the rare earth elements (R), whereby the coercivity iHc was improved further with the (BH)max remaining at an extremely high level of not less than 200 kJ/m$^3$ (25 MGOe (Japanese Patent KOKAI Publication No. 60-34005 (1985) or EPA 134304).

However, the permanent magnet formed by the Fe-B-R type magnetically anisotropic sintered body, while exhibiting the above mentioned excellent magnetic properties, has the contents of the rare earth elements and iron, that are apt to be oxidized in air to form gradually stable oxides, as the main constituents, so that, when the magnet is assembled in the magnetic circuit, various problems may be invited due to oxides formed on the magnet surface, such as decreased output of the magnetic circuit, fluctuations in the operation of the various magnetic circuits and contamination of various peripheral devices around the magnetic circuits due to scaling off of the resultant oxides from the magnet surface.

Therefore, with a view to improving the corrosion resistance of the above mentioned Fe-B-R type permanent magnet, there was already proposed a permanent magnet having a corrosion-resistant metal plating layer formed on the magnet surface by an electroless plating method or by the electrolytic plating method (Japanese Patent Application No. 58-162350 (1983), now KOKAI publication No. 60-54406. However, since the permanent magnet is a sintered porous body, there is a risk with these plating method that an acidic or alkaline solution from the pre-plating operation may remain within the pores to cause corrosion with the lapse of time, and that, since the magnet body is inferior in its resistance to chemicals, the magnet surface may be attacked during plating to cause deterioration in adhesivity and corrosion resistance.

The results of tests on corrosion resistance with the magnet being left for 100 hours under the conditions of the temperature of 80° C. and the relative humidity of 90% have also revealed that the magnetic properties exhibited deterioration of 10% or more from its initial properties and remained extremely unstable. Problems to be solved by the invention Furthermore, as the Fe-B-R type permanent magnet which could successfully solve the disadvantages inherent in the abovementioned plating method, spraying method and dipping method, and provide stabilized corrosion resistant property over a long period of time, there were also proposed improved permanent magnets provided on its surface with a vapor-deposited corrosion-resistant layer composed of various metals or alloys (Japanese Patent Applications No. 59-278489, No. 60-7949, No. 60-7950 and No. 60-7951, now corresponding EPA 0190461). By this vapor-deposition method, oxidation of the surface of the magnet body is suppressed, so that the magnetic properties are prevented from deterioration. Also, since there is no necessity for corrosive chemicals, etc., hence no apprehension whatsoever of its remaining in the magnet body as is the case with the plating method, the permanent magnet as treated by this method is capable of retaining its stability over a long period of time.

While the vapor-deposition method is effective for improvement in the corrosion resistance of the permanent magnet, it has its own disadvantage such that its productivity is low, so that the treatment by this method is considerably expensive.

In view of the foregoing, the present Applicant has made it clear that, by forming an electroless plating layer composed of at least one noble metal selected from the group consisting of palladium (Pd), silver (Ag), platinum (Pt) and gold (Au) and at least one base metal selected from the group consisting of nickel (Ni), copper (Cu), tin (Sn) and cobalt (Co), by an electroless plating method, on the surface of the above mentioned Fe-B-R type sintered magnet body, the electroless plating layer becomes dense, such that the deterioration of the initial magnetic properties of the permanent magnet may be reduced to not more than 10% in case of changes in the external environment, such as humidity on gases (Japanese Patent Application Nos. 62-73920

(1987), 62-90045, 62-90046 and 62-100980; now corresponding KOKAI Publication Nos. 63-238240, 63-255376, 63-254702 and 63-266020).

However, should the base metal layer be formed by the electroless plating method after the noble metal layer has been formed on the surface of the permanent magnet, adhesivity of the metal layers become inferior, such that, in the above mentioned tests on corrosion resistance, it becomes occasionally not possible to reduce the deterioration of the initial magnetic properties to 5% or less.

In addition, should the base metal layer be formed by the electrolytic plating method after the noble metal layer is formed on the surface of the permanent magnet, a tough metal coating would be obtained. However, in such case, the rare earth elements as the constituents of the magnet tends to be solved into the plating solution from the surface of the sintered magnet body to cause the corrosion to start from the interior of the magnet body.

SUMMARY OF THE DISCLOSURE

It is a principal object of the present invention to provide an Fe-B-R type permanent magnet having an improved corrosion resistance. It is another object of the present invention to provide an Fe-B-R type permanent magnet whose magnetic properties and deterioration from the initial magnetic properties is not more than 5% when the magnet is left for long time under the atmospheric conditions of a temperature of 80° C. and relative humidity of 90%, and further to provide a method for producing such magnet.

With a view to providing an Fe-B-R permanent magnet which has superior adhesivity and corrosion resistance and, above all, stable magnetic properties, even when the magnet is left for prolonged time under the atmospheric conditions of the temperature of 80° C. and the relative humidity of 90%, the present inventors conducted various investigations concerning surface treatment of the permanent magnet body, and found that superior adhesivity and corrosion resistant properties and highly stable magnetic properties may be obtained by applying a composite metal layer comprised of a primary noble metal layer, a base metal layer by electroless plating thereon, and another base metal layer applied by electrolylic plating on the firstly stated base metal layers.

As a first aspect of the present invention, there is provided a corrosion-resistant permanent magnet formed of a sintered body of a permanent magnet consisting essentially of 10 to 30 atomic % of R, wherein R is at least one of Nd, Pr, Dy, Ho and Tb, or at least one of Nd, Pr, Dy, Ho and Tb and at least one of La, Ce, Sm, Gd, Er, Eu, Tm, Yb, Lu and Y, 2 to 28 atomic % of B and 65 to 80 atomic % of Fe, and having a tetragonal phase as a major phase, said magnet further comprising on the surface of said sintered body:

a layer of at least one noble metal selected from the group consisting of Pd, Ag, Pt and Au, an electroless plating layer, formed on the noble metal layer, of at least one base metal selected from the group consisting of Ni, Cu, Sn and Co containing P and/or B, and on the surface of said electroless plating layer, a highly adherent metal coating formed of an electrolytic plating layer of at least one base metal selected from the group consisting of Ni, Cu, Sn and Co, the permanent magnet exhibiting deterioration of not more than 5% from the initial magnetic properties, when tested, after being tested for 500 hours under the conditions of a temperature of 80° C. and a relative humidity of 90%.

According to a second aspect of the present invention there is provided a method for producing a corrosion-resistant permanent magnet comprising:

providing a permanent magnet sintered body consisting essentially of 10 to 30 atomic % of R, wherein R is at least one of Nd, Pr, Dy, Ho and Tb, or at least one of Nd, Pr, Dy, Ho and Tb and at least one of La, Ce, Sm, Gd, Er, Eu, Tm, Yb, Lu and Y, 2 to 28 atomic % of B and 65 to 80 atomic % of Fe, and having a tetragonal phase as a major phase, causing at least one colloidal noble metal selected from the group consisting of Pd, Ag, Pt and Au to be adsorbed on, or forming a thin layer of at least one noble metal selected from the group consisting of Pd, Ag, Pt and Au on the surface of the sintered body, applying at least one base metal selected from the group consisting of Ni, Cu, Sn and Co containing P and/or B by electroless plating, and applying, on the resultant electroless plating layer, at least one base metal selected from the group consisting of Ni, Cu, Sn, and Co, by electrolytic plating, thereby to produce the corrosion-resistant permanent magnet exhibiting deterioration of not more than 5% from the initial magnetic properties, when tested, after being tested for 500 hours under the conditions of a temperature of 80° C. and a relative humidity of 90%.

Preferably the base metal electroless plating layer includes P and/or B in the amount of no more than 14% by weight for P and/or no more than 7% by weight for B for providing high strength and density of the plating layer in case of Ni and/or Co.

More specifically, the present inventors have found that, when simply a metal layer composed of at least one of base metals selected from the group consisting of nickel (Ni), copper (Cu), tin (Sn) and cobalt (Co) is coated on the surface of the above mentioned Fe-B-R type sintered magnet, by the electroless plating method, the magnetic properties are deteriorated and become unstable under hostile corrosive testing conditions including allowing the magnet to stand for 100 hours at 60° C. at the relative humidity of 90%. In contrast thereto in accordance with the present invention, when either a colloid of at least one noble metal selected from the group of Pd, Ag, Pt and Au is adsorbed on the surface of the sintered magnet body, or an electroless plating layer of at least one base metal selected from the group of Ni, Cu, Sn and Co, preferably containing P and/or B (particularly for Ni and/or Co), and an electrolytic plating layer of at least one base metal selected from the group of Ni, Cu, Sn and Co, are stackedly formed in this order on the previously deposited thin layer of noble metal as described above, the electroless plating layer is further improved in dense texture and adhesivity as a result of further formation of the electrolytic plating layer, so that the permanent magnet may be protected more fully against changes in the external environments, such as humidity or gases.

The present inventors have also found that, when the electrolytically plated base metal layer is applied directly on the surface of the sintered magnet, rare earth elements are solved out into the plating solution from the surface of the sintered magnet to accelerate the corrosion from inside of the sintered magnet body, whereas, when an electroless plated layer of at least one base metal containing phosphorus (P), boron (B), or phosphorus (P) and boron (B) is applied on the magnet surface and an electrolytically plated layer of at least one base metal is then applied on the so-formed electroless plated layer, the rare earth elements may be prevented from solving out into the plating solution thereby eliminating the corrosion from inside of the sintered magnet body.

The noble metal layer serves to reduce the solving out amount of rare earth elements as well as to unify and homogenize the deposited electroless base metal plating layer by providing uniform initiation of deposition. This layer further assures the adhesivity of the upper plating layers.

The electroless base metal plating layer (primary plating layer) serves as a barrier layer to inhibit the solving out of rare earth elements during the subsequent electrolytic plating step through penetration of the electrolytic plating solution. This layer is believed to be substantially poreless as exhibited in the Examples (refer to Table 2).

The outermost plating layer (secondary plating layer) formed of the electrolytic base metal plating layer serves as a dense and firm anticorrosive layer formed of a thick plating layer of a low cost and being firmly adhered to the sintered magnet body.

PREFERRED EMBODIMENTS

According to the present invention, the layer of the noble metal selected from the group of palladium (Pd), silver (Ag), platinum (Pt) and gold (Au) on the surface of the sintered magnet may be formed by adsorption of a colloid dispersed into a non-aqueous solvent or an aqueous solvent, or by application of any one of gas (or vapor) phase film forming methods as known per se, such as, for example, vacuum deposition, ion sputtering or ion plating (generally referred to as "vapor deposition technology"). Preferably, the noble metal layer has a thickness of 1 to 10 nm (10 to 100Å).

According to the present invention, the method for adsorbing the noble metal colloid on the surface of the sintered magnet preferably consists in dispersing a colloid of at least one noble metal selected from the group consisting of Pd, Ag, Pt and Au in a non-aqueous solvent or a neutral aqueous solvent in a pH range of 6.0 to 9.0 and immersing the sintered magnet in the solvent, or in coating a solution containing the metal colloid dispersed therein on the surface of the sintered magnet.

According to the present invention, as the non-aqueous solvent containing the noble metal colloid dispersed therein, hydrocarbons such as benzene, toluene or xylene, halogenated hydrocarbons such as trichloro trifluoroethane, chloroform or trichloroethane or ethyl acetate, are most preferred.

As the neutral aqueous solution containing the noble metal colloid dispersed therein, such solution containing uniformly dispersed noble metal particles having the particle size of 2 to 5 nm (20 to 50 Å), which is produced by reducing noble metal salts, such as palladium chloride, in the presence of a water-soluble dispersing agent, with a water-soluble reducing agent, such as tin chloride or hydrazin, may be employed.

As the water-soluble dispersing agent, anionic surfactants, such as sodium dodecylbenzene sulfonate, may be employed.

The pH value of the neutral aqueous solution is preferably 6.0 to 9.0. With the pH value less than 6.0, the surface of the sintered magnet becomes corroded. On the other hand, with the pH value higher than 9.0, there is difficulty in obtaining a solvent in which the noble metal colloid is stably dispersed.

According to the present invention, it is preferred that the layer of at least one base metal selected from the group of Ni, Cu, Sn and Co containing not more than 14 wt % of P and/or not more than 7 wt % of B, is applied by the electroless plating method to a thickness of preferably at least about 0.5 μm and not more than 10 μm (and more preferably 1 (or further 2) to 7 μm). As this type, any type of the electroless plating methods known in the art may be employed. The lower limit is selected according to the surface roughness of the substrate body, i.e., sintered magnet surface. However, the thickness of the electroless plating layer may be reduced when the magnet surface has been machined or finished to a highly flat surface, e.g., by polishing, lapping or equivalent methods. The thickness of about one μm would be sufficient for the sintered magnet surface pretreated by grinding or blasting.

When the electroless plating method is employed, P and/or B derived from sodium hypophosphite, dimethylamine boron or sodium boron hydride, employed as the reducing agent, is inevitably contained in the base metal layer.

The pH value of the electroless plating solution is preferably 6.0 to 9.5. With the pH value less than 6.0, the surface of the sintered magnet becomes corroded. On the other hand, with the pH value higher than 9.5, there occurs no precipitation of base metals.

The base metal layer formed on the electroless plating layer is deposited by the electrolytic plating method to a thickness of preferably 5 to 60 μm, more preferably 5 to 50 μm and most preferably 10 to 25 μm.

Generally it is preferred for giving a suitable substrate body that the surface of the sintered magnet is pretreated by machining, e.g., grinding, cutting and/or sand blasting followed by washing and drying in order to provide a fresh surface before applying the inventive layers. Reason of Limiting Compositional Ratios of Permanent Magnet The rare earth elements (R) employed in the permanent magnet of the present invention accounts for 10 to 30 atomic % of the total composition and preferably contains at least one of neodymium (Nd), praseodymium (Pr), dysprosium (Dy), holmium (Ho) and terbium (Tb) or optionally further at least one of lanthanum (La), cerium (Ce), samarium (Sm), gadolinium (Gd), erbium (Er), europium (Eu), thulium (Tm), ytterbium (Yb), lutecium (Lu) and yttrium (Y).

Although one of the elements (Nd, Pr, Dy, Ho and Tb) of R usually suffices, a mixture of two or more elements, such as mischmetal or didymium, may be employed in practice for convenience in availability.

Meanwhile, it is not essential for the elements of R to be pure rare earth elements. That is, technically inevitable impurities may be contained in R within the range of industrial availability.

The elements of R are indispensable in the above mentioned system of the permanent magnet. If the amount of R is less than 10 atomic %, the crystal structure becomes the same cubic structure as that of α-iron, so that high magnetic properties, above all, the high coercivity, cannot be achieved. If the amount of R exceeds 30 atomic %, the non-magnetic phase rich in R becomes exessive, and the residual magnetic flux density Br is lowered, so that the permanent magnet having superior properties cannot be obtained. Therefore, the amount of 10 to 30 atomic % of the rare earth elements is preferred.

Boron (B) is also an indispensable element in the permanent magnet of the present invention. If the amount of B is less than 2 atomic %, the rhombohedral structure represents the major phase, such that high coercivity iHc cannot be obtained. If the amount of B exceeds 28 atomic %, the non-magnetic phase rich in B becomes excessive and the residual magnetic flux density Br is lowered, and hence the permanent magnet having superior magnetic properties cannot be produced. Therefore, the amount of 2 to 28 atomic % of boron (B) is preferred.

Iron (Fe) is an indispensable element in the above permanent magnet system. If the amount of Fe is less than 65 atomic %, the residual magnetic flux density Br is lowered. On the other hand, if the amount of Fe is higher than 80 atomic %, high coercivity cannot be obtained. Therefore, the amount of Fe of 65 to 80 atomic % are preferred.

Also, partial substitution of cobalt (Co) for iron (Fe) in the permanent magnet of the present invention results in improved temperature characteristics without impairing magnetic properties of the produced magnet. If the amount of substitution by Co for Fe exceeds 20% of Fe, the magnetic properties are undesirablly lowered. The amount of substitution by Co such that the Co substitution for Fe in 5 to 15 atomic % is desirable for obtaining the high magnetic flux density (Br) is increased as compared with the case in which Fe is not replaced by Co.

Meanwhile, although the presence of industrially and technically inevitable impurities besides the elements R, B and Fe may be tolerated in the permanent magnet of the present invention, the permanent magnet may be produced at reduced costs with improved producibility by partially replacing B by at least one of not more than 4.0 atomic % of carbon (C), not more than 3.5 atomic % of phosphorus (P), not more than 2.5 atomic % of sulphur (S) and not more than 3.5 atomic % of copper (Cu), with the sum of the contents of C, P, S and Cu being not more than 4.0 atomic %.

At least one of the following additive elements may be added for improving of the coercivity, the squareness in the demagnetization curves and producibility and lowering the manufacture costs of the R-B-Fe type permanent magnet. That is, the permanent magnet may be endowed with higher coercivity with contents in the permanent magnet of at least one of following additional elements: not more than 9.5 atomic % of aluminum (Al), not more than 4.5 atomic % of titanium (Ti), not more than 9.5 atomic % of vanadium (V), not more than 8.5 atomic % of chromium (Cr), not more than 8.0 atomic % of manganese (Mn), not more than 5.0 atomic % of bismuth (Bi), each not more than 9.5 atomic % of niobium (Nb), tantalum (Ta), molybdenum (Mo) and wolfram (W), not more than 2.5 atomic % of antimony (Sb), not more than 7 atomic % of germanium (Ge), not more than 3.5 atomic % of tin (Sn), not more than 5.5 atomic % Zirconium (Zr), not more than 9.0 atomic % of nickel (Ni), not more than 9.0 atomic % of silicon (Si), not more than 1.1 atomic % of zinc (Zn) and not more than 5.5 atomic % of hafnium (Hf);

provided that, with the contents in the permanent magnet of not less than two of the above elements, the contents of these elements summed together need be not more than the maximum amount of that element which has the maximum upper limit value of the contents.

The crystalline phase having the tetragonal crystal structure as the major phase (i.e., at least 50 volume % of the sintered magnet) is indispensable in preparing the sintered permanent magnet having superior magnetic properties from fine and uniform alloy powders.

The permanent magnet of the present invention is characterized in that the tetragonal crystal structure having a mean crystal grain size in the range from 1 to 80 μm represents the major phase and in that there are contained at least 1 volume % of the non-magnetic phase excluding the oxide phase.

The permanent magnet according to the present invention a coercivity iHc≧80 kA/m (1 kOe), a residual magnetic flux density Br>0.4 T (4 kG), a maximum energy product (BH)max≧80 kJ/m$^3$ (10 MGOe), with the maximum value of the energy product (BH)max reaching not less than 200 kJ/m$^3$ (25 MGOe). (1 kOe=79.6 kA/m, 1 kG=$10^{-1}$ T, 1 MGOe=7.96 kJ/m$^3$)

When the light rare earth elements, mainly neodymium (Nd) and praseodymium (Pr), account for the major portion, such as not less than 50%, of the rare earth elements R of the permanent magnet of the present invention, and when the permanent magnet consists essentially of 12 to 20 atomic % of R, 4 to 24 atomic % of B and 74 to 80 atomic % of Fe, the permanent magnet exhibits superior magnetic properties of (BH)max of not less than 280 kJ/m$^3$ (35 MGOe), with the maximum value of (BH)max reaching a value of not less than 360 kJ/m$^3$ (45 MGOe) when the light rare earth metal is neodymium (Nd).

Also, according to the present invention, as the permanent magnet exhibiting extremely high corrosion resistance as demonstrated in the corrosion resistance tests wherein the permanent magnet is left for a prolonged period of time in an environment of a temperature of 80° C. and a relative humidity of 90%, that having a composition of 11 to 15 atomic % of Nd, 0.2 to 3.0 atomic % of Dy, with the amounts of Nd and Dy summed together being 12 to 17 atomic %, 5 to 8 atomic % of B, 0.5 to 13 atomic % of Co, 0.5 to 4 atomic % of Al and not more than 1000 ppm of carbon (C), with the balance being Fe and technically inevitable impurities, is preferred.

EXAMPLES

The present invention will be explained hereinbelow with reference to Examples and comparative Examples.

It is noted that quantitative analysis of the rare earth element Nd solved out into the plating solution was performed using a ICAP 575 type emission plasma spectroanalyser.

EXAMPLE 1

Electrolytic iron having a purity of 99.9%, a ferroboron alloy containing 19.4% of B, and Nd and Dy each having a purity of not less than 99.7% were used as the starting material. These ingredients were mixed together, melted with high frequency melting and cast to produce an ingot having a composition of 14Nd-0.5Dy-7B-78.5Fe in terms of atomic percent.

The ingot was crushed and pulverized finely to produce finely divided powders having a mean particle size of 3 μm.

The fine powders were charged into a metallic dies of a press and, under orientation in a magnetic field of 960 kA/m (12 kOe), were pressed under a pressure of 147

MPa (1.5 ton/cm$^2$) in a direction parallel to the magnetic field. The pressed compact was sintered at 1100° C. for two hours under an argon atmosphere. The sintered body was subjected to ageing at 800° C. for one hour under an argon atmosphere subsequently at 630° C. for one and a half hour to produce a sintered magnet of 13 mm in diameter and 2 mm in thickness having a density of about 7.5 g/cm$^3$ which is close to 100% of the theoretical density.

A test piece of 12 mm in diameter and 1.2 mm in thickness was produced from the sintered magnet by grinding using a universal grinder for the circumference and a surface grinder for upper and bottom surfaces to remove the black skin of the sintered body followed by washing and drying. This pretreated surface generally includes micro-recesses or micro-deffects resulting from micropores in the sintered body, the surface being greyish-black in color.

The magnetic properties of the test piece of the sintered magnet are shown in Table 1.

The above test piece was immersed for ten minutes in toluene containing a palladium colloid having a particle size of about 2 nm (20 Å) dispersed therein to vaporize toluene of the dispersion medium to produce a Nd-Dy-B-Fe type permanent magnet having the palladium colloid adsorbed on its surface. The adsorbed surface showed brown color.

An electroless nickel plating solution, pH 8.5, containing 0.1 mole/lit. of nickel (Ni), 0.15 mole/lit. of sodium hypophosphite, 0.2 mole/lit. of sodium citrate and 0.5 mole/lit. of ammonium phosphate was prepared. The Nd-Dy-B-Fe type permanent magnet having the above mentioned palladium colloid adsorbed on its surface was immersed in this electroless nickel plating solution at 80° C. for 30 minutes, washed with water and dried.

The permanent magnet produced had a metallic luster of the electroless nickel plating (i.e., the primary plating layer) on its surface.

The result of emission plasma spectroanalysis of the permanent magnet using the ICAP 575 type emission plasma spectrometric analyser has revealed that the amounts of palladium (Pd), nickel (Ni) and prosphorus (P) based on the sample weight amounted to 0.01 wt %, 1.2 wt % and 0.02 wt %, respectively, the thickness of the Pd layer was 5.5 nm (55 Å) and that of the Ni layer containing P was 2.5 μm.

The above mentioned Nd-Dy-B-Fe type permanent magnet, on the surface of which the electroless nickel plating layer had been formed, was immersed in a Ni electrolytic plating solution of pH 4.5 containing 240 g/lit. of nickel sulfate, 45 g/lit. of nickel chloride and 30 g/lit. of boric acid, and electroplating was then performed by applying the current for 45 minutes so that the cathodic current density was maintained at 2.0 A/dm$^2$. The permanent magnet was then washed with water and dried to produce an electrolytic plating layer (secondary plating layer).

The so-produced permanent magnet presented a metallic surface luster of the electrolytic nickel plating layer. The result of the emission plasma spectroanalyses has revealed that the electroless nickel plating layer and the electrolytic nickel plating layers had a total thickness equal to 17 μm.

Table 2 shows the results of analysis of Nd solved out into each of the electroless nickel plating solution and electrolytic nickel plating solution after the end of plating and the results of the tests on adhesivity (Pressure cooker testing PCT: 125° C.×85% RH×2 atm, 1 atm=0.101 MPa).

The properties and the state of deterioration of thus produced the permanent magnet of the present Example, after the magnet had been left for 500 hours at the temperature of 80° C. and under the relative humidity of 90%, were then measured. The results are shown in Table 1.

EXAMPLE 2

The sintered magnet body obtained by using the same composition and under the same manufacture conditions as those of Example 1 was used as the test piece.

This test piece was immersed for 15 minutes in pure water in which the palladium colloid having a particle size of about 3 nm (30 Å) was dispersed. The test piece was then washed with water and dried to produce a Nd-Dy-B-Fe type permanent magnet having the palladium colloid adsorbed on its surface.

An electroless nickel plating solution of pH 8.5 containing 0.15 mole/lit. of sodium hypophosphite, 0.2 mole/lit. of sodium citrate and 0.5 mole/lit. of ammonium sulfate, at the Ni concentration of 0.1 mole/lit. was prepared. The above mentioned Nd-Dy-B-Fe type permanent magnet, which has adsorbed the above mentioned palladium colloid on its surface, was immersed in this electroless nickel plating solution at 80° C. for 40 minutes, washed with water and dried.

The produced permanent magnet presented a metallic surface luster of the electroless nickel plating layer (primary plating layer).

The result of the emission plasma spectroanalyses of the above mentioned permanent magnet with the aid of the ICAP 575 type emission plasma spectroanalyser has revealed that the amounts of Pd, Ni and P based on the weight of the sample amount to 0.01 wt %, 1.5 wt % and 0.12 wt %, respectively, while the thickness of the palladium layer was 6 nm (60 Å) and that of the phosphorus containing nickel layer amounted to 2.0 μm.

Then, the above mentioned Nd-Dy-B-Fe type permanent magnet, on the surface of which the electroless nickel plating layer had been formed, was subjected to electrolytic plating under the same conditions and with the use of the same composition as those of the preceding Example 1, washed with water and dried to produce an electrolytic plating layer (secondary plating layer).

The permanent magnet thus produced had the metallic surface luster of the electrolytic plating layer. The result of emission plasma spectroanalyses has revealed that the total thickness of the electroless nickel plating layer and the electrolytic nickel plating layer amounted to 15 μm.

The results of analyses of Nd solved out into each of the electroless nickel plating solution and the electrolytic nickel plating solution after termination of plating and the results of the tests adhesivity (PCT: 125° C.×85% RH×2 atm) are shown in Table 2.

The properties and the state of deterioration of the produced permanent magnet of the present Example, after the magnet had been left for 500 hours under the conditions of the temperature of 80° C. and the relative humidity of 90%, were measured. The results are shown in Table 1.

EXAMPLE 3

Using the sintered magnet produced under the same conditions and with the use of the same composition as those in the preceding Example 1, as the test piece, a Pd-Pt alloy film was applied to a thickness of 5 nm (50 Å) on the magnet surface by ion-sputtering in a vacuum atmosphere of 6.7 Pa (0.05 Torr).

The above mentioned sintered magnet, coated by the Pd-Pt alloy film, was then subjected to electroless plating (primary plating) under the same compositions and the same operating conditions as those of the Example 1.

The electroless nickel plating produced had a thickness of 3.0 μm and a metallic luster.

The above mentioned Nd-Dy-B-Fe type permanent magnet, the surface of which the electrolytic plating layer had been formed, was subjected to electrolytic plating (secondary plating) under the same composition and with the use of the same conditions as those of the preceding Example 1, to produce an electrolytic nickel plating layer.

The permanent magnet produced presented a metallic surface luster of the electrolytic nickel plating layer. The result of the emission plasma spectroanalyses have revealed that the total thickness of the electroless nickel plating layer and the electrolytic nickel plating layer amounted to 18 μm.

Table 2 shows the results of analyses of Nd solved into each of the electroless nickel plating solution and the electrolytic nickel plating solution after termination of each plating and the results of the tests on adhesivity (PCT: 125° C.×85% RH×2 atm).

The properties and the state of deterioration of the permanent magnet of the present Example thus obtained after the magnet had been left for 500 hours under the conditions of 80° C. and the relative humidity of 90%, were measured. The results are shown in Table 1.

EXAMPLE 4

Instead of the electroless nickel plating solution of Example 1, an electroless copper plating solution containing 0.5 mole/lit. of copper (Cu), 0.8 mole/lit. of potassium sodium tartrate, 0.8 mole/lit. of sodium hydroxide and 6.3 mole/lit. formaldehyde was used. In this electroless copper plating solution was immersed a sintered magnet test piece, on which the same palladium colloid as in Example 1 had been adsorbed, for 60 minutes at room temperature, to form an electroless copper plating layer. The resultant copper-plating layer had metallic luster with a red-copper color. The electroless copper plating layer had a thickness of 1.5 μm according to measurement by an emission plasma spectrometric analyser of the ICAP 575 type.

Then, the electroless copper-plated test piece was subjected to electrolytic nickel plating under the same plating solution composition and plating conditions as in Example 1 resulting in a plating layer thickness of 14 μm in total of the electroless (Cu) and electrolytic (Ni) platings.

Analogous to Example 1, the solved out amounts of Nd into plating solutions (electroless=primary; electrolytic=secondary) were measured and are shown in Table 2. Analogous to Example 1, the magnetic properties were measured before and after the PCT testing and the results are shown in Table 1.

COMPARATIVE EXAMPLE 1

The sintered magnet with a palladium coating 5.5 nm (55 Å) in thickness, obtained under the same manufacture conditions and with the use of the same composition as those of the preceding Example 1, was subjected to electroless plating (primary plating) with immersing for 90 minutes otherwise under the same electroless plating conditions as those employed in the Example 1. The electroless nickel plating layer yielded had a thickness of 10 μm.

Table 2 shows the result of analyses of Nd solved into the electroless plating solution after termination of plating and the results of tests on adhesivity (PCT: 125° C.×85% RH×2 atm).

Measurements were made on the properties of the permanent magnet after surface treatment as well as the properties and the state of deterioration of the permanent magnet after the magnet had been left for 500 hours under the conditions of the temperature of 80° C. and the relative humidity of 90%. The results are shown in Table 1.

COMPARATIVE EXAMPLE 2

The Pd-coated sintered magnet, obtained by using the same composition and the same manufacture conditions as those of the preceding Example 1 was subjected to electrolytic plating (only primary plating) by using the electrolytic Ni plating solution of the same composition as that of the preceding Example 1 and maintaining the electric current to flow therethrough at a cathodic current density of 1 A/dm$^2$ to produce a Nd-Dy-B-Fe type permanent magnet having a Pd layer 5.5 nm (55 Å) in thickness on the surface of the sintered magnet and an electrolytic Ni plating layer 20 μm in thickness on the surface of the Pd layer.

Table 2 shows the results of analyses of Nd solved into the electrolytic plating solution after termination of plating and the results of tests on adhesivity (PCT: 125° C.×85% RH×2 atm).

Measurements were made of the properties of the permanent magnet after surface treatment as well as the properties and the state of deterioration of the permanent magnet after the magnet had been left for 500 hours under the conditions of the temperature of 80° C. and the relative humidity of 90%. The results are shown in Table 1.

COMPARATIVE EXAMPLE 3

A Nd-Dy-B-Fe type permanent magnet having a palladium (Pd) layer 6 nm (60 Å) in thickness on the surface of the sintered magnet and a Ni plating layer of 19 μm in thickness by electrolytic plating on the surface of the Pd layer was produced in the same way as in the preceding Example 2, except that, in place of forming the Ni plating layer by electroless plating, an electrolytic plating (primary plating) was performed by using the same electrolytic plating solution as that in the preceding Example 1 and causing the current to flow there through at a cathodic current density of 0.6 A/dm$^2$ to form an electrolytic nickel plating layer to a thickness of 4.5 μm.

Table 2 shows the results of analyses of Nd solved into the electrolytic plating solution after termination of plating and the results of tests on adhesivity (PCT: 125° C.×85% RH×2 atm).

Measurements were made on the properties of the permanent magnet after surface treatment as well as the properties and the state of deterioration of the permanent magnet after the magnet had been left for 500 hours under the conditions of the temperature of 80° C. and the relative humidity of 90%. The results are shown in Table 1.

COMPARATIVE EXAMPLE 4

A Nd-Dy-B-Fe type permanent magnet having a Pd-Pt layer of 5 nm (50 Å) in thickness on the surface of the sintered magnet and a Ni plating layer of 20 μm in thickness by electroplating on the surface of the Pd-Pt layer was produced in the same way as in the preceding Example 3, except that, in place of forming the Ni plating layer by electroless plating, an electrolytic plating (primary plating) was performed by using the same electrolytic plating solution as that in the preceding Example 3 and causing the current to flow there through at a cathodic current density of 0.6 A/dm$^2$ to form a Ni plating layer to a thickness of 5.2 μm.

Table 2 shows the results of analyses of Nd solved into the electrolytic plating solution after termination of plating and the results of tests on adhesivity (PCT: 125° C.×85% RH×2 atm).

Measurements were made on the properties of the permanent magnet after surface treatment as well as the properties and the state of deterioration of the permanent magnet after the magnet had been left for 500 hours under the conditions of the temperature of 80° C. and the relative humidity of 90%. The results are shown in Table 1.

TABLE 1

| | Magnetic Properties Before Test on Corrosion Resistance | | | | | | Magnetic Properties | | | | | |
|---|---|---|---|---|---|---|---|---|---|---|---|---|
| | After Ageing | | | After Surface Treatment | | | After Tests on Corrosion Resistance | | | Rate of Deterioration of Magnetic Properties (%) | | |
| | Br(kG)* | iHc** (kOe) | (BH)max*** (MGOe) | Br(kG) | iHc (kOe) | (BH)max (MGOe) | Br(kG) | iHc (kOe) | (BH)max (MGOe) | Br(kG) | iHc | (BH)max |
| Ex. 1 | 11.2 | 15.3 | 30.1 | 11.2 | 15.3 | 30.1 | 11.2 | 15.1 | 29.4 | <1 | 1.3 | 2.3 |
| Ex. 2 | 11.2 | 15.3 | 30.1 | 11.2 | 15.3 | 30.1 | 11.2 | 15.1 | 29.5 | <1 | 1.3 | 2.0 |
| Ex. 3 | 11.2 | 15.3 | 30.1 | 11.2 | 15.3 | 30.1 | 11.2 | 15.1 | 29.4 | <1 | 1.3 | 2.3 |
| Ex. 4 | 11.2 | 15.3 | 30.1 | 11.2 | 15.3 | 30.1 | 11.2 | 15.1 | 29.3 | <1 | 1.3 | 2.7 |
| Comp. Ex. 1 | 11.2 | 15.3 | 30.1 | 11.2 | 15.3 | 30.0 | 11.2 | 14.9 | 28.6 | <1 | 2.6 | 5.0 |
| Comp. Ex. 2 | 11.2 | 15.3 | 30.1 | 11.2 | 14.8 | 28.3 | 11.1 | 13.9 | 27.6 | <1 | 9.2 | 8.3 |
| Comp. Ex. 3 | 11.2 | 15.3 | 30.1 | 11.2 | 14.9 | 28.5 | 11.1 | 14.0 | 27.8 | <1 | 8.5 | 7.6 |
| Comp. Ex. 4 | 11.2 | 15.3 | 30.1 | 11.2 | 14.8 | 28.3 | 11.1 | 13.8 | 27.5 | <1 | 9.8 | 8.6 |

$$\text{Rate of Deterioration of Magnetic Properties (\%)} = \frac{\left(\text{Magnet Properties After Tests on Corrosion Resistance}\right) - \left(\text{Magnet Properties After Ageing}\right)}{\text{Magnet Properties After Ageing}}$$

*1kG = $10^{-1}$T
**1kOe = 79.6 kA/m
***1MGOe = 7.96 kJ/m$^3$

TABLE 2

| | Solved-Out Amount of Nd in μg per sintered magnet | | Results of Test on Adhesivity (PCT: 125° C. × 85% RH × 2atm)* |
|---|---|---|---|
| | primary plating | secondary plating | |
| Ex. 1 | electroless plating 0 | electrolytic plating 1.5 | no peeling for 72 hours |
| Ex. 2 | electroless plating 0.5 | electrolytic plating 5.4 | no peeling for 72 hours |
| Ex. 3 | electroless plating 0 | electrolytic plating 0 | no peeling for 72 hours |
| Ex. 4 | electroless plating 0.4 | electrolytic plating 5.0 | no peeling for 72 hours |
| Comp. Ex. 1 | electroless plating 0.5 | — | peeling after 24 hours |
| Comp. Ex. 2 | electrolytic plating 620 | — | no peeling for 60 hours |
| Comp. Ex. 3 | electrolytic plating 880 | electrolytic plating 25 | no peeling for 60 hours |
| Comp. Ex. 4 | electrolytic plating 850 | electrolytic plating 17 | no peeling for 60 hours |

*1atm = 0.101 MPa

EFFECT OF THE INVENTION

With the Fe-B-R type permanent magnet of the present invention, only a small amount of neodymium (Nd) is solved out into the plating solution after the end of use of the electrolytic plating solution, as may be seen from the embodiments. The magnet exhibits superior adhesivity and undergoes deterioration in the magnetic properties of not more than 5% from the initial magnetic properties after the magnet had been left for 500 hours under the hostile anti-corrosive test conditions, above all, under the conditions of the temperature of 80° C. and the relative humidity of 90%. It is most suited as the inexpensive high performance permanent magnet which is currently most desired.

DISCUSSION

As shown in Table 2, the solved-out amount of Nd is reduced to a minimum level (0 to 0.5 μg per sintered magnet) due to the presence of the primary plating layer (Examples 1 to 3), whereas the direct electrolytic plating (Comparative Examples 2 to 4) suffers an unacceptably great solved-out amount of Nd (620 to 880 μg per sintered magnet). The very low level of the solved-out amount of Nd in Examples 1 to 4 exhibits that the primary plating layer is substantially poreless sufficient to barrier the solving-out of rare earth elements contained in the sintered magnet.

It should be noted that modification may be made without departing from the gist and concept of the present invention as disclosed herein within the scope of the appended claims.

What is claimed is:

1. A corrosion-resistant permanent magnet formed of a sintered body of a permanent magnet consisting essentially of 10 to 30 atomic % of R, wherein R is at least one of Nd, Pr, Dy, Ho and Tb, or at least one of Nd, Pr, Dy, Ho and Tb and at least one of La, Ce, Sm, Gd, Er, Eu, Tm, Yb, Lu and Y, 2 to 28 atomic % of B and 65 to 80 atomic % of Fe, and having a tetragonal phase as a major phase, said magnet further comprising on the surface of said sintered body:

a layer of at least one noble metal selected from the group consisting of Pd, Ag, Pt and Au, an electroless plating layer, formed on the noble metal layer, of at least one base metal selected from the group consisting of Ni, Cu, Sn and Co, and on the surface of said electroless plating layer, a highly adherent metal coating formed of an electrolytic plating layer of at least one base metal selected from the group consisting of Ni, Cu, Sn and Co, the permanent magnet exhibiting deterioration of not more than 5% from the initial magnetic properties, when tested, after being tested for 500 hours under the conditions of a temperature of 80° C. and a relative humidity of 90%.

2. A method for producing a corrosion-resistant permanent magnet comprising:

(a) providing a permanent magnet sintered body consisting essentially of 10 to 30 atomic % of R, wherein R is at least one of Nd, Pr, Dy, Ho and Tb, or at least one of Nd, Pr, Dy, Ho and Tb and at least one of La, Ce, Sm, Gd, Er, Eu, Tm, Yb, Lu and Y, 2 to 28 atomic % of B and 65 to 80 atomic % of Fe, and having a tetragonal phase as a major phase, (b) causing at least one colloidal noble metal selected from the group consisting of Pd, Ag, Pt and Au to be adsorbed on, or forming a thin layer of at least one noble metal selected from the group consisting of Pd, Ag, Pt and Au on the surface of the sintered body, (c) applying at least one base metal selected from the group consisting of Ni, Cu, Sn and Co by electroless plating, and (d) applying, on the resultant electroless plating layer, at least one base metal selected from the group consisting of Ni, Cu, Sn, and Co, by electrolytic plating, thereby to produce the corrosion-resistant permanent magnet exhibiting deterioration of not more than 5% from the initial magnetic property, when tested, after being tested for 500 hours under the conditions of a temperature of 80° C. and a relative humidity of 90%.

3. The corrosion-resistant permanent magnet as defined in claim 1, in which said noble metal layer is an adsorbed layer of colloidal noble metal.

4. The corrosion-resistant permanent magnet as defined in claim 1, in which said noble metal layer is a thin layer formed by vapor deposition technology.

5. The corrosion-resistant permanent magnet as defined in claim 3, in which said noble metal layer has a thickness of 1–10 nm.

6. The corrosion-resistant permanent magnet as defined in claim 1, in which said electroless plating layer of base metal has a thickness of 10 μm or less.

7. The corrosion-resistant permanent magnet as defined in claim 6, in which said electroless plating layer of base metal has a thickness of at least about 0.5 μm.

8. The corrosion-resistant permanent magnet as defined in claim 1, in which said electroless plating layer of the base metal has a thickness of 1–7 μm.

9. The corrosion-resistant permanent magnet as defined in claim 1, in which said electroless plating layer of the base metal has a thickness of 2–7 μm.

10. The corrosion-resistant permanent magnet as defined in claim 1, in which said electroless plating layer contains P and/or B and said base metal for the electroless plating layer is Ni and/or Co.

11. The corrosion-resistant permanent magnet as defined in claim 10, in which said electroless plating layer contains P and/or B in the amount of not more than 14 weight % for P and/or not more than 7 weight % of B.

12. The corrosion-resistant permanent magnet as defined in claim 1, in which said electrolytic layer of base metal has a thickness of 5 to 60 μm.

13. The corrosion-resistant permanent magnet as defined in claim 1, in which said electrolytic layer of base metal has a thickness of 5 to 50 μm.

14. The corrosion-resistant permanent magnet as defined in claim 1, in which said electrolytic layer of base metal has a thickness of 10 to 25 μm.

15. The corrosion-resistant permanent magnet as defined in claim 1, in which said base metal is Ni and/or Cu.

16. The corrosion-resistant permanent magnet as defined in claim 1, in which Co is substituted for Fe in the sintered body in an amount of 20 atomic % or less of the Fe.

17. The corrosion-resistant permanent magnet as defined in claim 1, in which at least one of additional elements is further included in the sintered body in the amount of not more than the value defined below:

| | |
|---|---|
| 9.5 atomic % Al, | 4.5 atomic % Ti, |
| 9.5 atomic % V, | 8.5 atomic % Cr, |
| 8.0 atomic % Mn, | 5.0 atomic % Bi, |
| 9.5 atomic % Nb, | 9.5 atomic % Ta, |
| 9.5 atomic % Mo, | 9.5 atomic % W, |
| 2.5 atomic % Sb, | 7 atomic % Ge, |
| 3.5 atomic % Sn, | 5.5 atomic % Zr, |
| 9.0 atomic % Ni, | 9.0 atomic % Si, |
| 1.1 atomic % Zn, and | 5.5 atomic % Hf. |

18. The corrosion-resistant permanent magnet as defined in claim 1, 15 or 16 in which at least 50 atomic % of said element R is Nd and/or Pr.

19. The corrosion-resistant permanent magnet as defined in claim 17, in which said element R is 12 to 20 atomic %, B is 4 to 24 atomic %, and Fe is 74 to 80 atomic %.

20. The corrosion-resistant permanent magnet as defined in claim 1, in which as the element R, 11 to 15 atomic % Nd, 0.2 to 3.0 atomic % Dy are present with the sum of Nd and Dy being 12 to 17 atomic %, and B is 5 to 8 atomic %, further, Co being present in an amount of 0.5 to 13 atomic %, Al being present in an amount 0.5 to 4.0 atomic %, and C being not more than 1000 ppm.

21. The method as defined in claim 2, in which the step (b) is effected by adsorbing colloidal noble metal.

22. The method as defined in claim 2, in which the step (b) is effected by forming a thin layer through vapor deposition technology.

23. The method as defined in claim 21, in which the adsorption of the colloidal noble metal is effected by a colloid dispersed in a nonaqueous medium or a neutral aqueous medium.

24. The method as defined in claim 23, in which said neutral aqueous medium is of pH 6.0 to 9.0.

25. The method as defined in claim 21, in which the colloid is dispersed in a diameter of 2 to 5 nm.

26. The method as defined in claim 2, in which a reducing agent including P and/or B and, as the base metal, Ni and/or Co are used for the step (c) of electroless plating.

27. The method as defined in claim 2, in which the step (c) of electroless plating is effected in a solution of pH 6.0 to 9.5.

28. The method as defined in claim 2, in which the step (b) is effected so as to form a noble metal layer of 1 to 10 nm.

29. The method as defined in claim 2, in which the step (c) is effected so as to form as electroless plating layer of base metal in a thickness of not more than 10 μm.

30. The method as defined in claim 29, in which the step (c) is effected so as to form as electroless plating layer of base metal in a thickness of 1 to 7 μm.

31. The method as defined in claim 29, in which the step (c) is effected so as to form as electroless plating layer of base metal in a thickness of 2 to 7 μm.

32. The method as defined in claim 2, in which the step (d) is effected so as to form an electrolytic plating layer of base metal in a thickness of 5 to 60 μm.

33. The method as defined in claim 2, in which the step (d) is effected so as to form an electrolytic plating layer of base metal in a thickness of 5 to 50 μm.

34. The method as defined in claim 32, in which the step (d) is effected so as to form an electrolytic plating layer of base metal in a thickness of 10 to 25 μm.

35. The method as defined in claim 23, in which said nonaqueous medium is selected from hydrocarbon, halogenated hydrocarbon and ethyl acetate.

36. The method as defined in claim 24, in which said colloidal noble metal is prepared through reducing a noble metal salt by a water soluble reducing agent under the presence of a water soluble dispersing agent.

37. The method as defined in claim 22, in which said vapor deposition technology is selected from vacuum deposition, ion sputtering or ion plating.

38. The method as defined in claim 26, in which the step (c) of electroless plating is effected so as not to exceed 7% by weight of B and/or 14% by weight of P in the resultant electroless plating layer.

39. The method as defined in claim 26, in which said reducing agent is selected from sodium hypophosphite, dimethyl amine boron and sodium boron hydride.

40. The method as defined in claim 2, in which said base metal is Ni and/or Cu.

41. The method as defined in claim 2, in which said Co is substituted for Fe in the sintered body in an amount of 20 atomic % or less of the Fe.

42. The method as defined in claim 2, in which at least one of additional elements is further included in the sintered body in the amount of not more than the value defined below:

| | |
|---|---|
| 9.5 atomic % Al, | 4.5 atomic % Ti, |
| 9.5 atomic % V, | 8.5 atomic % Cr, |
| 8.0 atomic % Mn, | 5.0 atomic % Bi, |
| 9.5 atomic % Nb, | 9.5 atomic % Ta, |
| 9.5 atomic % Mo, | 9.5 atomic % W, |
| 2.5 atomic % Sb, | 7 atomic % Ge, |
| 3.5 atomic % Sn, | 5.5 atomic % Zr, |
| 9.0 atomic % Ni, | 9.0 atomic % Si, |
| 1.1 atomic % Zn, and | 5.5 atomic % Hf. |

43. The method as defined in claim 2, 41 or 42 in which at least 50 atomic % of said element R is Nd and/or Pr.

44. The method as defined in claim 2, in which C is controlled so as not to exceed 1000 ppm in the sintered body.

* * * * *